United States Patent [19]

Horibe et al.

[11] Patent Number: 4,637,350

[45] Date of Patent: Jan. 20, 1987

[54] SYSTEM FOR RECOVERING DRAIN

[75] Inventors: Youshun Horibe; Yoshikuni Ohshima; Toyohiko Masuda, all of Hitachi, Japan

[73] Assignee: Hitachi, Ltd., Tokyo, Japan

[21] Appl. No.: 781,903

[22] Filed: Sep. 30, 1985

[30] Foreign Application Priority Data

Sep. 28, 1984 [JP] Japan ..... 59-201479

[51] Int. Cl.[4] ..... F22D 1/28; F22D 1/32

[52] U.S. Cl. ..... 122/441; 60/678; 122/1 R; 122/406 R

[58] Field of Search ..... 122/1 R, 6 R, 406 R, 122/412, 414, 415, 433, 441, 397, 398, 403, 451 R, 452; 60/657, 646, 678, 670

[56] References Cited

U.S. PATENT DOCUMENTS

| | | | |
|---|---|---|---|
| 3,277,651 | 10/1966 | Augsberger | 60/657 |
| 3,842,605 | 10/1974 | Tegtmeyer | 60/678 |
| 4,471,618 | 9/1984 | Tratz et al. | 60/646 |
| 4,498,301 | 2/1985 | Tsubouchi | 60/657 |
| 4,534,320 | 8/1985 | MacArthur et al. | 122/406 R |
| 4,561,255 | 12/1985 | Silvestri, Jr. | 60/678 |

FOREIGN PATENT DOCUMENTS

| | | | |
|---|---|---|---|
| 41604 | 4/1978 | Japan | 122/415 |
| 56-7903 | 1/1981 | Japan . | |

*Primary Examiner*—Albert J. Makay
*Assistant Examiner*—Steven E. Warner
*Attorney, Agent, or Firm*—Antonelli, Terry & Wands

[57] ABSTRACT

A system for recovering drain which recovers two or more flows or drain of different temperatures, which is applied to a generating plant provided with feed-water heaters in which drain is recovered into a condensation system downstream from a condenser through a drain tank by a drain pump and which comprises a high temperature recovered drain inlet, which is at high temperature and contains much flush steam, and a low temperature drain inlet. The high temperature recovered drain inlet is positioned at a lower part and the low temperature side drain inlet is positioned above the former. This system effects efficient degassing of drain which has high content of dissolved oxygen and efficient control of dissolved oxygen.

12 Claims, 9 Drawing Figures

SYSTEM FOR RECOVERING DRAIN

BACKGROUND OF THE INVENTION

This invention relates to a system for recovering drain of feed-water heaters in a generating plant, and, more particularly, to a system for recovering drain which is suitable for controlling a content of dissolved oxygen contained in feed water of, for example, a nuclear reactor.

In the condensation system of a conventional generating plant such as, for example, a BWR nuclear power plant, all cascade drain of feed-water heating apparatuses is recovered into a condenser and all water is degassed by a condenser and fed to a nuclear reactor through a condensed water processing apparatus so as to improve a quality of the water. However, the capacity of a low pressure condensation pump and the capacity of the condensed water processing apparatus must be increased.

Since BWR nucular power plants include a degassing apparatus, special considerations must be taken for degassing cascade drain.

While Japanese Laid Open Patent Application 7903/81 proposes a tank in a drain line, the proposal contained therein does not address the problems encountered in regulating a control of a content of dissolved oxygen contained in the condensed water.

The aim underlying the present invention essentially resides in providing a system for recovering drain which effects degassing cascade drain from feed-water heating apparatuses in a drain tank and facilitates controlling degassing ability in order to maintain the content of dissolved oxygen in condensed water within a range (normally 20–50 ppb) required as a system from the standpoint of resistance to corrosion.

There are roughly three approaches for reducing a content of the dissolved oxygen in recovered drain; namely, degassing by heating, separating by mechanical stirring, and venting. Of the above noted three approaches, degassing by heating and venting can be relatively easily controlled. It has also been determined that, if the content of the dissolved oxygen is extremely small, it does more harm than good from the standpoint of resistance to corrosion. Therefore, when the content of dissolved oxygen in the recovered drain is too small, another approach resides in increasing the oxygen content by injecting oxygen directly or leaking air. This last approach is, as with the degassing by heating and venting approaches, also easily controllable and a system which facilitates controlling the content of the dissolved oxygen optionally can be constituted by a combination of the above-noted approaches.

To this end, the present invention provides a system for recovering drain which recovers two or more flows or drain of different temperatures, which is applied to a generating plant provided with feed-water heaters in which drain is recovered into a condensation system downstream from a condenser through a drain tank by a drain pump and which comprises a drain tank, an inlet for drain of high temperature, which is at high temperature and contains much flush steam, and a low temperature drain inlet. The high temperature drain inlet is positioned at a lower part of the drain tank and the low temperature drain inlet is positioned above the former.

DETAILED DESCRIPTION

Figure 2:
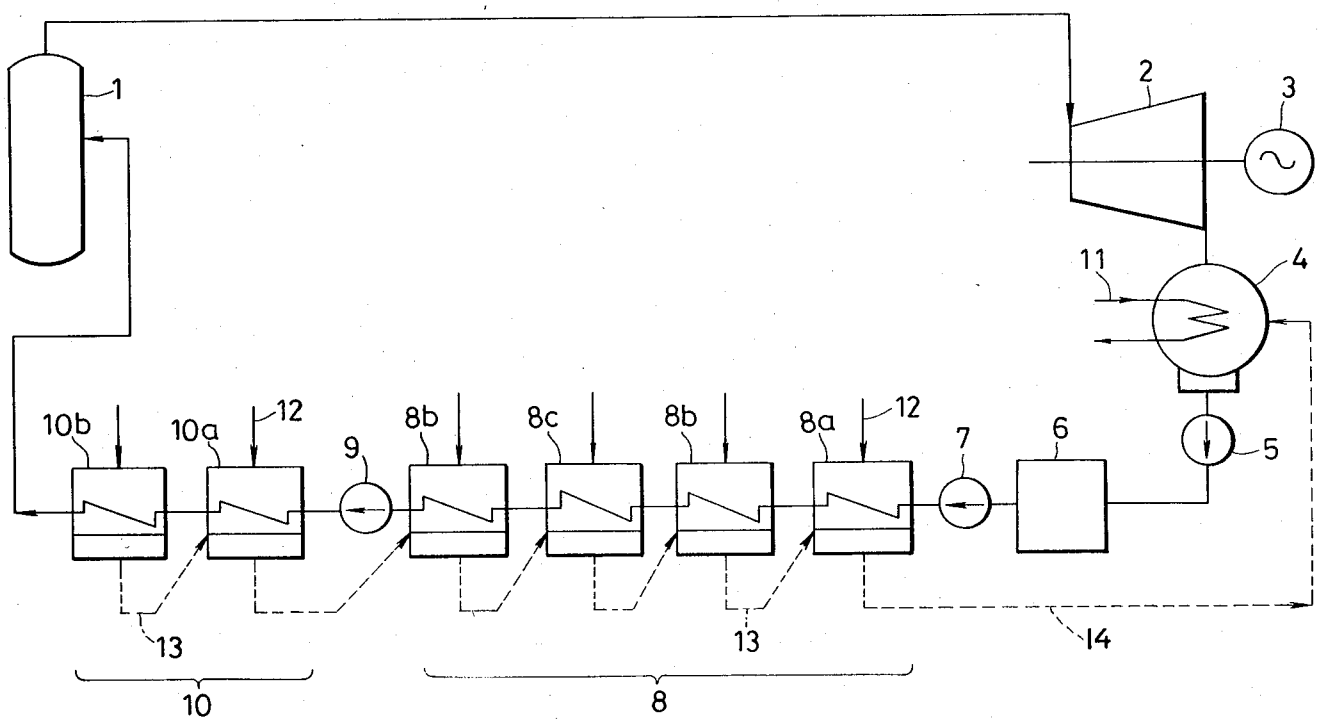
FIG. 2 is a schematic view of a prior art condensation system.
Figure 3:
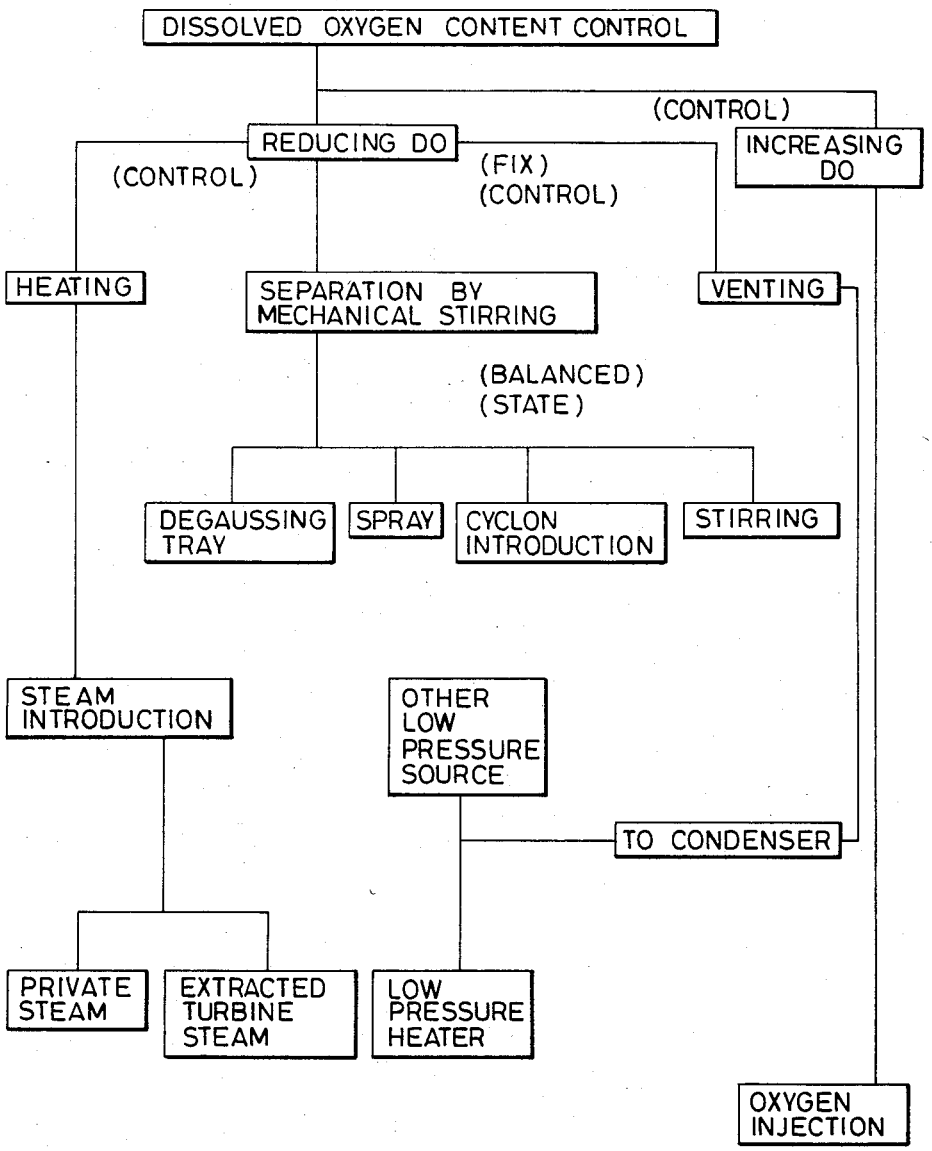
FIG. 3 is a diagram describing types of mechanisms of controlling content of dissolved oxygen.

Referring now to the drawings wherein like reference numerals are used throughout the various views to designate like parts and, more particularly, to FIG. 2, in a condensation system in a conventional generating plant, steam generated in a nuclear reactor 1 flows into a turbine 2 to which an electric generator 3 is connected to generate power and then flows into a condenser 4 provided with a cooling pipe 11. Condensed water flowing out of the condenser 4 is transferred to a condensed water processing apparatus 6 through a condensation pump 5. The condensed water processing apparatus 6 is adapted to exclude foreign substances so as to always maintain a quality of water in the condition necessary for a safe operation of the nuclear reactor 1. The condensed water from the condensed water processing apparatus 6 is further transferred under pressure, by a condensed water booster pump 7, to a low pressure feed-water heating apparatus 8 including low pressure feed-water heaters **8*a*–8*d* and heated by a steam 12 drawn out of the turbine and transferred under pressure, by a feed-water pump 9, to a high pressure feed-water heating apparatus 10 including high pressure feed-water heaters 10*a*, 10*b* by heated steam 12 as in the low pressure feed-water heating apparatus 8 and transferred to the nuclear reactor 1**.

Drain 13 of the high pressure and the low pressure feed water heating apparatus 10, 8 is transferred in a cascade adjacent to the lower pressure side, adjacent the right side of FIG. 2, to feed-water heaters and finally collected in the low pressure feed-water heater **8*a* and recovered into the condenser 4 through a drain pipe 14**.

Figure 1:
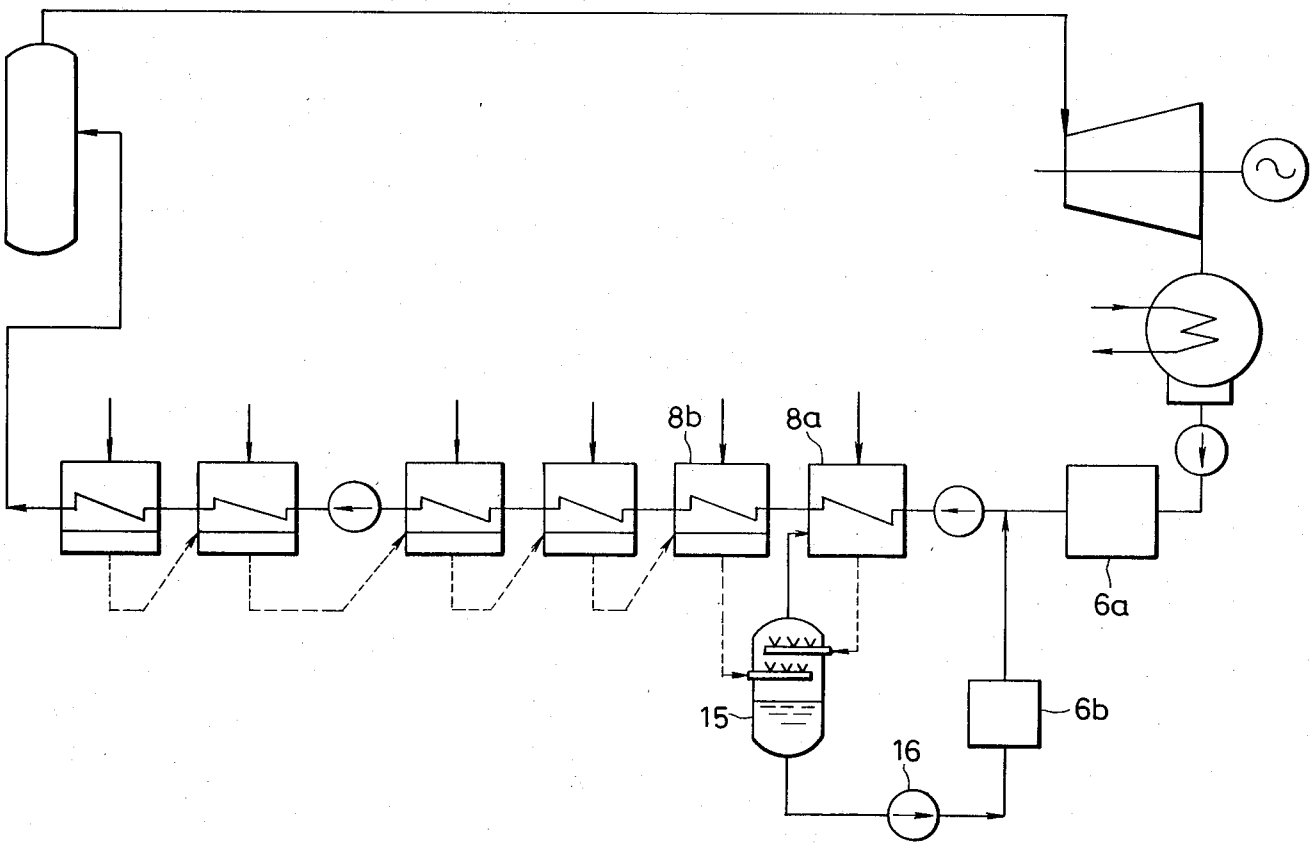
FIG. 1 is a schematic view of a condensation system of a plant to which a system of the present invention is applied.

As shown in FIG. 1, a condensation system of a plant to which the present invention is applied includes a drain tank 15 with from low pressure feed-water heaters **8*a* and 8*b* being recovered into the drain tank 15 and transferred into a water quality processing apparatus 6*b* through a drain pump 16** and processed so as to have the same water quality as condensed water from a condenser and pumped up to an upstream side of a condensed water booster pump. While the basic system itself is already known and its practical application is under study, a realization of a structure of a drain tank and a method for controlling the content of dissolved oxygen of a whole system are still under development;

therefore, the present invention attempts to attain the desired end by applying the concepts of the present invention to such basic system.

More particularly, in accordance with the present invention, the quantity of cascade drain is approximately 40% of the feed-water quantity to a nuclear reactor and capacities of a condensation pump 5 and a condensed water processing apparatus 6 can be reduced. Additionally, when drain is recovered into a condenser, heat held through the drain is discharged out of the system by cooling water as unavailable energy; however, with the drain recovering system of the present invention, the heat is not discharged and thermal efficiency can be significantly improved.

Figure 4:
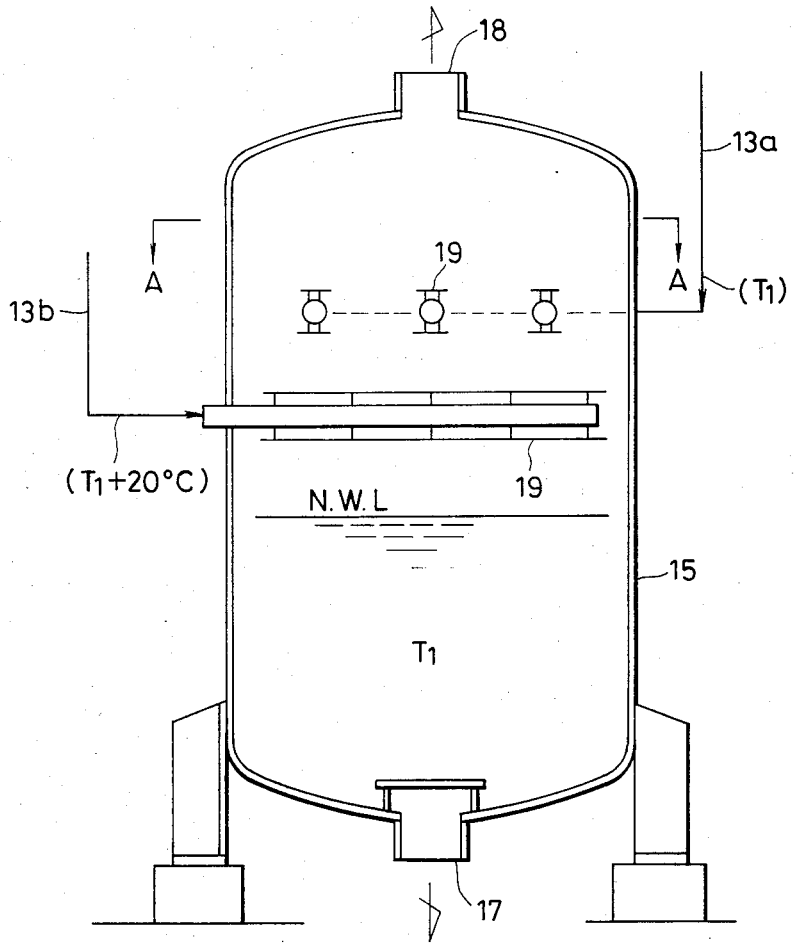
FIG. 4 is a schematic view of one embodiment of a drain recovering apparatus of the present invention.

In accordance with the present invention, as shown most clearly in FIG. 4, a vertical stand type drain tank 15 is provided, with a water level being maintained about a center of the tank. Drain of the low pressure feed water heaters 8*a* and 8*b* is recovered into this drain tank 15 and an inlet of the drain 13*a* from the low pressure feed water heater 8*a*, which drain has low temperature and high content of dissolved oxygen drain is positioned at an upper part and an inlet of the drain 13*b* from the low pressure feed water heater 8*b* which drain has high temperature and lower content of dissolved oxygen than the drain 13*a* drain is positioned below the inlet of the drain 13*a*. Normally, temperature difference of about 20° C. exists between temperatures of the two flows of drain (13*a* and 13*b*) as shown in FIG. 4. Pressure in the drain tank 15 is predetermined so as to be identical to the pressure in the low pressure feed-water heater 8*a* and as the temperature of the drain 13*b* from the low pressure feed-water heater 8*b* is higher than the temperature in the drain tank 15, after being introduced into the drain tank 15, the drain 13*b* produces flush steam.

The temperature of the drain 13*a* from the low pressure feed-water heater 8*a* is almost the same as the temperature in the drain tank 15 and the very little flush steam is produced. Also, a drain outlet 17 and a vent outlet 18 which is connected to the low pressure heater 8*a* are provided at lower and upper parts of the drain tank 15 respectively.

Figure 5:
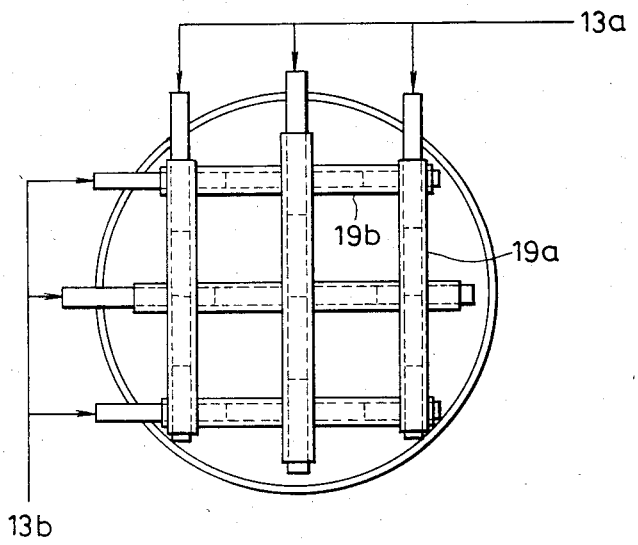
FIG. 5 is a transverse cross section of the apparatus shown in FIG. 4.

As shown in FIG. 5 taken along the line A—A in FIG. 4, each introduced flow of the drain 13*a* and the drain 13*b* is divided into three branches so that both flows of the drain are well mixed and stirred by spraying apparatuses with baffles 19*a* and 19*b*. Moreover, these spraying apparatuses are arranged into a grid as shown in the top view of FIG. 5 so that both flows of drain are efficiently mixed and stirred in a limited space of the drain tank 15 as shown in FIG. 5.

Figure 6:
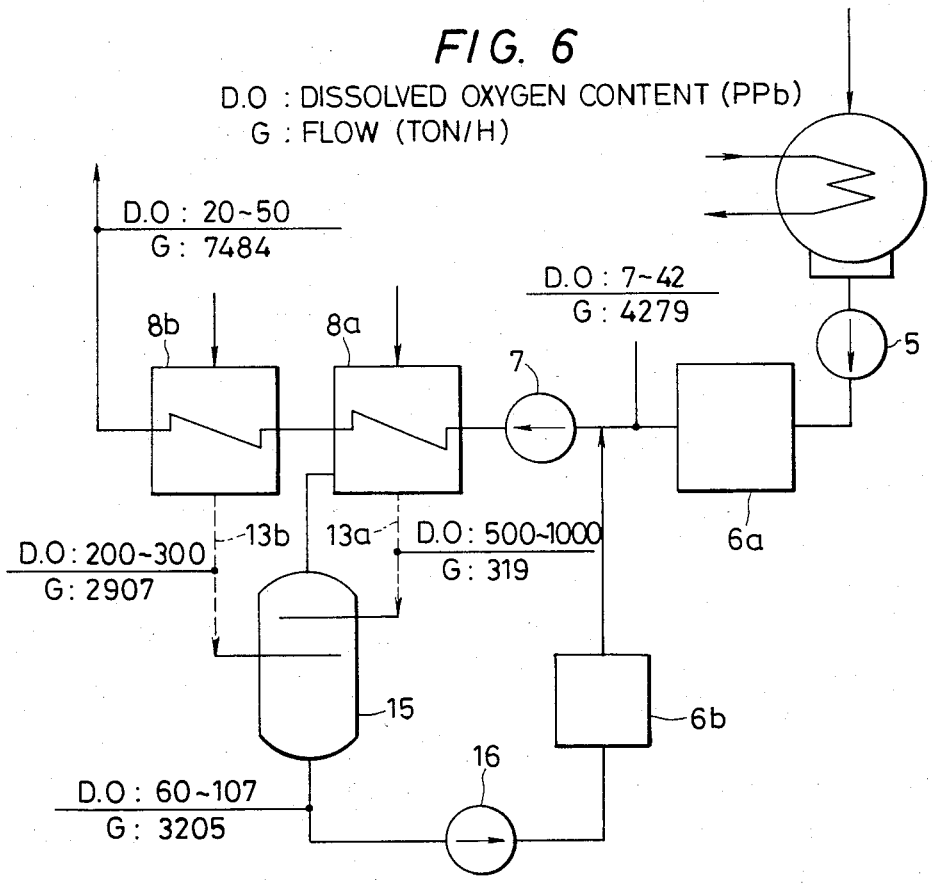
FIG. 6 is a schematic view around the drain recovering apparatus of the present invention.

FIG. 6 shows typical values for quantities such as flow of condensed water, flow of drain and content of dissolved oxygen. The content of the dissolved oxygen DO required at the entrance of the nuclear furnace is 20–50 ppb and according to the past record of dissolved oxygen DO in the condensed water in the condenser is about 7–42 ppb.

In other words, from above quantities, allowable dissolved oxygen DO (at the drain tank exit) of the drain pumped up to the upstream side of the condensed water booster pump is 60–70 ppb.

Therefore, the content of 500–1000 ppb and 200–300 ppb of the dissolved oxygen DO in the introduced drain must be reduced to within the range of 60–107 ppb in the drain tank 15 and the embodiment of the present invention described by FIG. 4 and FIG. 5 is so constituted as to accomplish this function.

With above-described embodiment, the drain from the low pressure feed-water heaters which has a high dissolved oxygen content can be degassed efficiently. In other words, if there is no effect of degassing in the drain tank, the dissolved oxygen DO in the drain is determined in accordance with the following relationship:

$$DO = \frac{(200\sim300) \times 2907 + (500\sim1000) \times 319}{2907 + 319}$$

$$\approx 230\sim370 \text{ ppb.}$$

But a dissolved oxygen DO of 60–107 ppb required at the drain tank exit shown in FIG. 6 can be obtained.

Also, the heat recovered by pumping up the cascade drain into the condensation system through the drain tank amounts approximately 15 MW calculated with a 1300 MW BWR nuclear plant.

Figure 7:
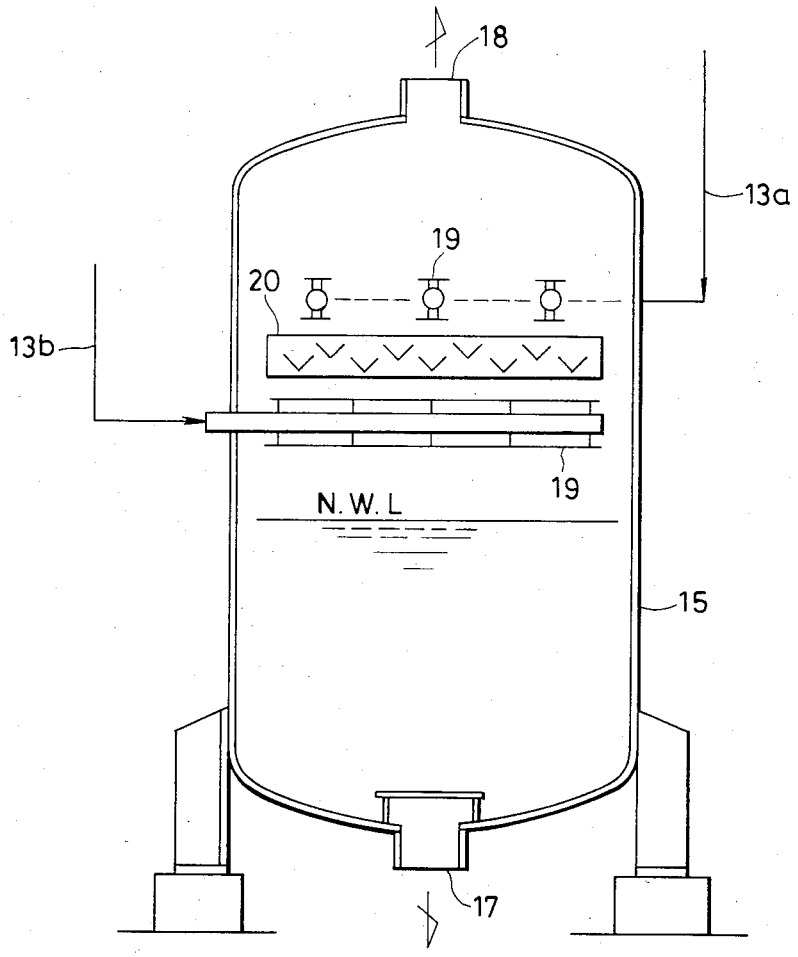
FIG. 7 is a schematic view of another embodiment of the preset invention.

In the embodiment of FIG. 7 a system for recovering drain comprises a degassing tray 20 provided between the spraying apparatuses 19 of the drain 14*a* and 13*b* from the low pressure feed water heaters in order to further improve the degassing efficiency. With the embodiment shown in FIG. 4, the drain is degassed only during natural falling. With this modified embodiment, enough time can be taken in the degassing tray 20 to make sufficient contact stirring and achieve high efficiency degassing. A technology which provides a degassing tray for the purpose of separation by mechanical stirring is the technology already established in conventional degassing apparatuses and by applying this technology, a more reliable degassing effect can be obtained with a simplified structure. Therefore, this technology can be an efficient means to further improve the degassing effect compared to that of the embodiment shown in FIG. 4.

Figure 8:
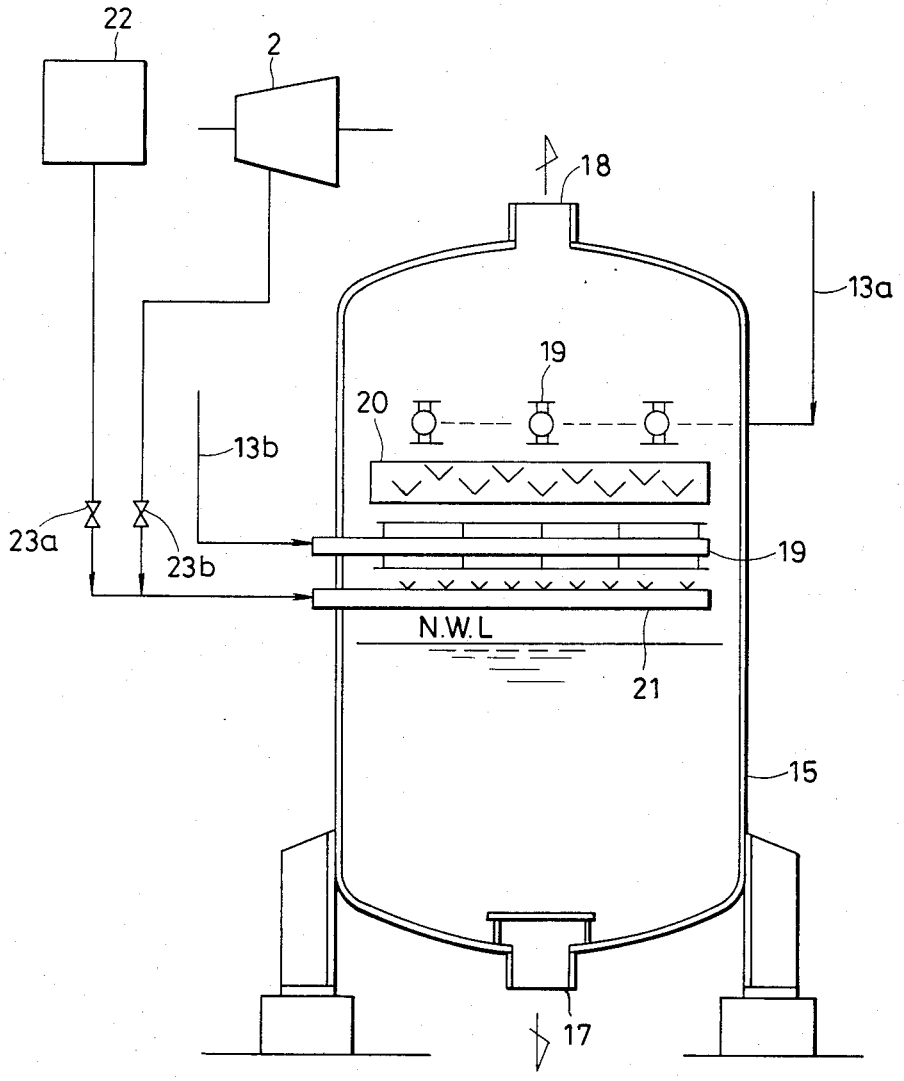
FIG. 8 is a schematic view of a further embodiment of the the present invention.

The embodiment of FIG. 8 attempts to further improve the degassing efficiency by introducing degassing steam from outside the system. That is to say, a degassing steam supply pipe 21, which introduces degassing steam supplied from the system outside the drain tank, is provided below the spraying apparatuses 19 of the drain from the low pressure feed-water heaters. The degassing steam supply pipe 21 can be constituted by a plurality of pipes laid in parallel and arranged so as to spray upward. The steam supply source of the degassing steam supply pipe 21 is an extracted gas of a turbine 2 or a steam generator 22 within the system and can be selected by steam supply valves 23*a* and 23*b* depending on the respective operating conditions.

From the standpoint of economy, gas extracted from the turbine reduces the cost of fuel. However, in a BWR nuclear power plant, the extracted air from the turbine contains oxygen produced by the decomposition of water in the nuclear furnace and has a higher oxygen content than the steam from the private steam generator. Therefore, by selecting the degassing steam supply source taking the dissolved oxygen content in the system for recovering drain into account, efficient degassing and economical plant operation can be realized.

Figure 9:
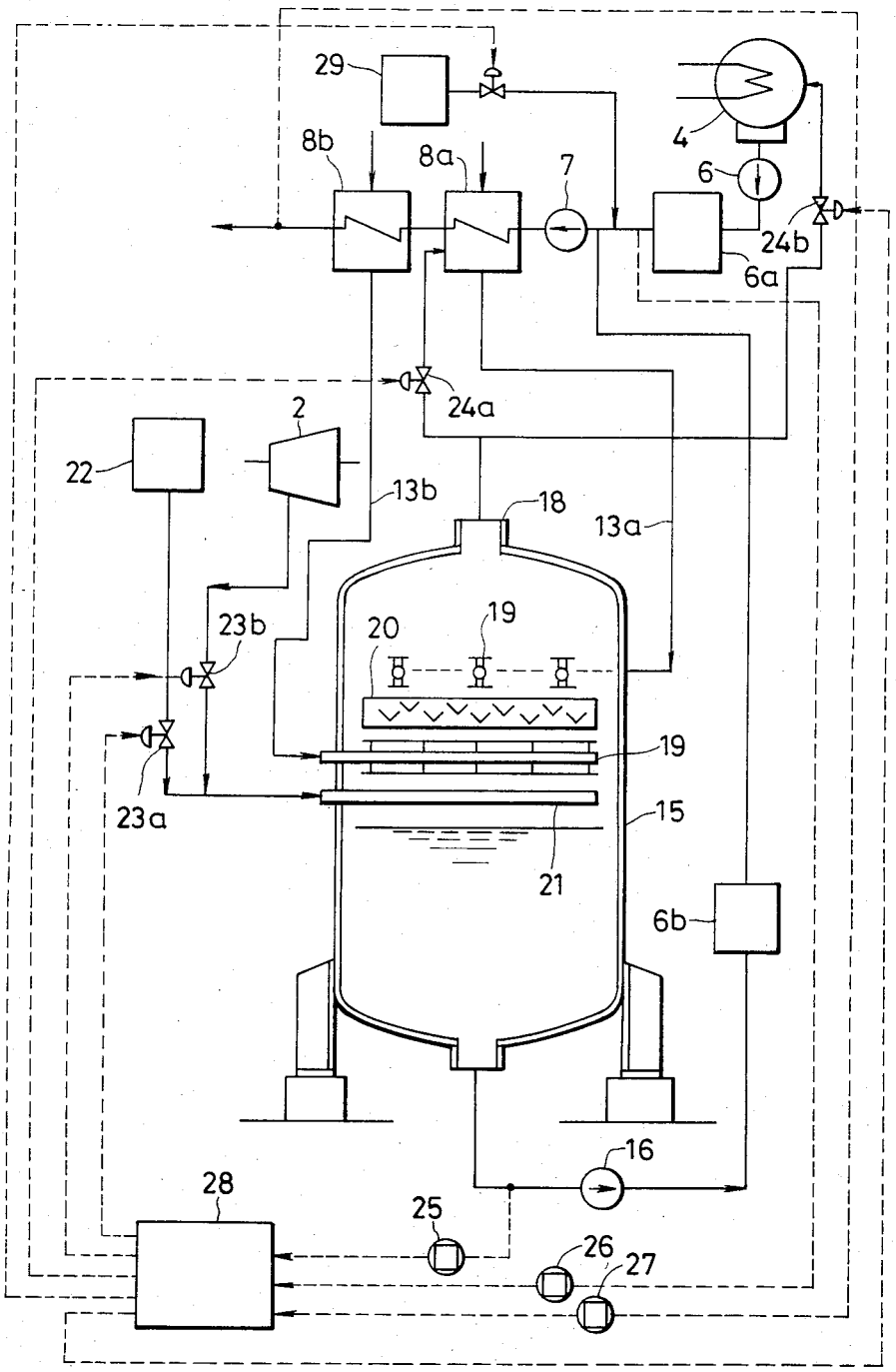
FIG. 9 is a schematic view of yet another embodiment of the present invention.

In the embodiment of FIG. 9, the vent outlet 18 from the drain tank 15 is connected to the low pressure feed-water heater 8*a* and the condenser 4 and vent switching valves 24*a* and 24*b* are provided in the respective connecting systems.

Because the condenser 4 has a lower operating pressure than the low pressure feed-water heater 8*a*, when the vent outlet from the drain tank 15 is connected to the condenser, higher vent efficiency can be obtained and the degassing efficiency is improved. However, the heat efficiency of the plant is better when venting is applied to the low pressure feed-water heater 8*a* so that the connection can be selected taking a balance with the dissolved oxygen content at the drain tank exit into account.

Also in this embodiment, data from a dissolved oxygen content detector 25 at the drain tank exit, a dissolved oxygen content detector 26 at the condensed water processing apparatus exit and a dissolved oxygen content detector 27 at the feed-water heater exit are put into a microcomputer 28. In order to control the dissolved oxygen content in feed-water to the nuclear furnace reactor to a value predetermined for the system, a selection instruction for degassing steam supply valves 23*a* and 23*b* and drain tank vent switching valves 24*a* and 24*b* is given by the microcomputer 28 in accordance with a predetermined program.

It is to be noted that the microcomputer 28 can also give an instruction to an oxygen injection source valve 30 connected to an oxygen injection apparatus 29 and when the content of the dissolved oxygen in the condensed water drops below the value predetermined for the system to the point where it cannot be controlled by the switching of the supply sources of the degassing steam or the switching of the objects of the drain tank vent connection, little oxygen remains in the condensed water; therefore, the injected quantity from the oxygen injection apparatus 29 can also be controlled. In other words, with the present invention, the content of the dissolved oxygen in the feedwater supplied to the nuclear furnace reactor can be determined very accurately so as to create conditions most suitable for the system following the fluctuation of the output power or of the water quality.

The present invention effects efficient degassing of drain which has high content of dissolved oxygen and efficient control of dissolved oxygen.

What we claim is:

1. A system for recovering drain, which is applied to a generating plant provided with feed-water heaters from which drain is recovered into a condensation system including a condenser, said system comprising:

a drain tank;

a high temperature drain inlet for drain to be recovered of high temperature, containing a considerable volume of flush steam, said high temperature drain inlet being provided on said drain tanks, and communicated with one of said feed-water heaters on a low pressure side;

a low temperature drain inlet for drain to be recovered, said low temperature drain inlet being provided on said drain tank to be positioned above said high temperature drain inlet and communicated with said feed-water heaters on a low temperature side;

a first spraying apparatus, provided in said drain tank so as to communicate with said high temperature drain inlet;

a second spraying apparatus provided in said drain tank so as to communicate with said low temperature drain inlet;

a vent outlet provided on said drain tank;

a drain outlet provided on said drain tank; and a drain pump for transferring drain in said drain tank to said condensation system on the downstream side of said condenser.

2. A system for recovering drain, the system being applied to a generating plant provided with feed-water heaters from which drain is recovered into a condensation system on a downstream side of a condenser through a drain tank, the system comprising:

means for recovering two or more flows of drain of different temperatures;

a high temperature inlet for recovered drain at high temperature containing a larger volume of flush steam, said inlet being positioned at a lower part;

a low temperature inlet for recovered drain positioned above said high temperature inlet for recovered drain; and at least one of a degassing apparatus is provided between a high temperature drain recovering part and a low temperature drain recovering part and a degassing apparatus provided below the high temperature drain recovering part and the low temperature drain recovering part to reduce the content of dissolved oxygen in the recovered drain.

3. A system for recovering drain according to claim 2, wherein steam is introduced into said drain tank from outside of said drain tank in addition to the recovered drain in order to degas the recovered drain.

4. A system for recovering drain according to claim 3, wherein main steam from said generating plant is introduced as said introduced steam.

5. A system for recovering drain according to claim 3, wherein steam within the generating plant is introduced as said introduced steam.

6. A system for recovering drain of feed-water heaters in a generating plant provided with a nuclear reactor, a turbine driven by steam from said nuclear reactor, a condensation system including a condenser and said feed-water heaters for heating feed-water by steam to produce drain caused to flow in cascades through said feed-water heaters and recovered into said condensation system, said system for recovering drain comprising:

a drain tank for recovering drain from said feed-water heaters;

a high temperature drain inlet, provided on said drain tank, for introducing drain of high temperature containing a larger volume of flush steam into said drain tank;

a low temperature drain inlet, provided on said drain tank at a higher position than said high temperature drain inlet, for introducing drain of lower temperature than said high temperature drain into said drain tank;

a first spraying apparatus, connected to said high temperature drain inlet, for spraying the drain from said high temperature drain inlet in said drain tank;

a second spraying apparatus, connected to said low temperature drain inlet, for spraying the drain from said low temperature drain inlet over the sprayed drain of high temperature;

a vent outlet provided on an upper portion of said drain tank;

a drain outlet provided on a lower portion of said drain tank; and a drain pump for transferring drain in said drain tank into said condensation system on a downstream side of said condenser through said drain outlet.

7. A system for recovering drain as claimed in claim 6, wherein said low temperature drain inlet communicates with the lowest pressure feed-water heater of said feed-water heaters arranged in cascades, high temperature inlet communicating with a higher pressure feed-water heater adjacent to said lowest temperature feed-water heater, and said vent outlet communicating with at least one of said lowest pressure feed-water heater and said condenser.

8. A system for recovering drain as claimed in claim 7, wherein a degassing apparatus is provided between said first and second spraying apparatus.

9. A system for recovering drain according to claim 8, wherein said degassing apparatus is a degassing tray.

10. A system for recovering drain according to claim 7, wherein a degassing steam supply apparatus is provided under said second spraying apparatus.

11. A system for recovering drain according to one of claims 3, 4, 5 or 10, wherein outside steam supply sources for supplying steam into said drain tank are provided, said outside steam supply sources being switched so that one of said outside steam supply sources may be optionally used to supply steam.

12. A system for recovering drain according to one of claims 1, 2, or 7, wherein dissolved oxygen content detectors are provided for detecting dissolved oxygen content of drain from said drain outlet of said drain tank, dissolved oxygen content of condensate and dissolved oxygen content of feed-water, and means are provided for controlling the content of dissolved oxygen in feed-water to a predetermined value based on data from said detectors.

* * * * *